US009821927B1

(12) United States Patent
McLaughlin

(10) Patent No.: US 9,821,927 B1
(45) **Date of Patent: *Nov. 21, 2017**

(54) SUSPENSION PAD FOR A CORRUGATED ENCLOSURE

(75) Inventor: Brian C. McLaughlin, Burt, MI (US)

(73) Assignee: Security Packaging, Inc., Flint, MI (US)

( * ) Notice: Subject to any disclaimer, the term of this patent is extended or adjusted under 35 U.S.C. 154(b) by 1521 days.

This patent is subject to a terminal disclaimer.

(21) Appl. No.: 13/246,356

(22) Filed: Sep. 27, 2011

Related U.S. Application Data

(63) Continuation of application No. 11/268,344, filed on Nov. 7, 2005, now Pat. No. 8,038,009.

(51) Int. Cl.

| | |
|---|---|
| ***B65D 81/02*** | (2006.01) |
| ***B65D 43/00*** | (2006.01) |
| ***B65D 85/30*** | (2006.01) |
| ***B65D 5/50*** | (2006.01) |

(52) U.S. Cl.
CPC ..... *B65D 5/5035* (2013.01)

(58) Field of Classification Search
CPC .. B65D 5/5069; B65D 5/5052; B65D 5/5054; B65D 5/505; B65D 5/5053
USPC ..... 206/583, 586, 588, 591, 592
See application file for complete search history.

(56) References Cited

U.S. PATENT DOCUMENTS

| | | | | |
|---|---|---|---|---|
| 2,906,445 | A * | 9/1959 | Tabakof et al. | 206/586 |
| 3,356,278 | A * | 12/1967 | Layne, Sr. | 206/322 |
| 6,276,525 | B1 * | 8/2001 | Kobeluch et al. | 206/315.1 |
| 6,685,025 | B1 * | 2/2004 | Kari | 206/583 |
| 7,021,024 | B2 * | 4/2006 | Kari | 206/583 |

* cited by examiner

*Primary Examiner* — Chun Cheung
(74) *Attorney, Agent, or Firm* — Young Basile Hanlon & MacFarlane, P.C.

(57) ABSTRACT

A suspension pad for suspending a workpiece with respect to a corrugated enclosure having a closure flap that is moveable between an open position, wherein an opening is defined in the corrugated enclosure, and a closed position, wherein the opening is obstructed by the closure flap. The suspension pad has a mid-section that is engageable with the workpiece, and at least one end portion moveable between a raised position, wherein the end portion is disposed within the corrugated enclosure, and a lowered position, wherein the end portion extends through the opening to hold the closure flap in the open position.

12 Claims, 2 Drawing Sheets

SUSPENSION PAD FOR A CORRUGATED ENCLOSURE

CROSS-REFERENCE TO RELATED APPLICATIONS

The present application is a continuation of U.S. patent application Ser. No. 11/268,344, filed on Nov. 7, 2005.

FIELD OF THE INVENTION

The present invention relates to the field of corrugated enclosures, and more particularly, the present invention relates to a suspension pad for a corrugated enclosure that holds the corrugated enclosure open during loading and unloading.

BACKGROUND OF THE INVENTION

In many packaging applications, it is known to provide pads or blocks on the interior surfaces of corrugated enclosures to separate the workpiece shipped inside the corrugated container from the walls of the corrugated container. Such an arrangement is particularly useful in shipping applications where fragile goods are being shipped. Furthermore, as these types of containers are usually employed in factories, the enclosures are often preassembled so that they may be filled as the workpieces are produced.

To accommodate rapid placement of completed workpieces into corrugated enclosures, the closure flaps of such corrugated enclosures are placed in an open position so that the workpiece may be readily placed inside the corrugated container when it is produced. However, the fold of the closure flap may bias the closure flap to the closed position, thereby requiring a first person to open the closure flaps, while a second person inserts the workpiece into the corrugated enclosure. This requires two people to load the workpiece, which creates an inefficiency that is undesirable in an industrial environment.

Furthermore, the pads or blocks intended to separate the workpiece from the closure flaps are typically adhered to one of the closure flaps such that the pad or block engages the workpiece when the flap is closed. Such an arrangement hinders insertion of the workpiece into the corrugated enclosure, as the pad or block often causes the flap to close prematurely, or the pad or block obstructs the opening of the corrugated enclosure. Again, such a design creates an inefficiency that is undesirable in an industrial environment.

It would be desirable to provide a suspension pad for a corrugated enclosure that holds a workpiece in spaced relationship with a corrugated enclosure and that holds the closure flaps of the corrugated container open without obstructing the opening of the corrugated enclosure during loading.

SUMMARY OF THE INVENTION

The present invention provides a suspension pad for suspending a workpiece with respect to a corrugated enclosure. The corrugated enclosure includes a closure flap moveable between an open position, wherein an opening is defined in the corrugated enclosure, and a closed position, wherein the opening is obstructed by the closure flap. The corrugated enclosure may include a closure strip that is engageable with a closure pad on the closure flap to thereby hold the closure flap in the closed position.

The suspension pad has a mid-section and a first end portion that is connected to the mid-section by a transverse fold. The first end portion is moveable between a raised position, wherein the first end portion is disposed within the corrugated enclosure, and a lowered position, wherein the first end portion extends through the opening. The first end portion is engageable with the closure flap to hold the closure flap in the open position when the first end portion is in the lowered position. The suspension pad may also have a second end portion opposite the first end portion. The first and second end portions may function to separate the workpiece from one or more surfaces of the corrugated enclosure.

The mid-section is engageable with the workpiece and includes a substantially planar middle portion connected to a pair of sides by longitudinal folds. The pair of sides of the mid-section are engageable with a first surface of the corrugated enclosure, thereby spacing the middle portion of the mid-section from the first surface of the corrugated enclosure.

BRIEF DESCRIPTION OF THE DRAWINGS

The description herein makes reference to the accompanying drawings, wherein like-referenced numerals refer to like parts throughout the several views and wherein.

DETAILED DESCRIPTION OF THE INVENTION

Figure 1:
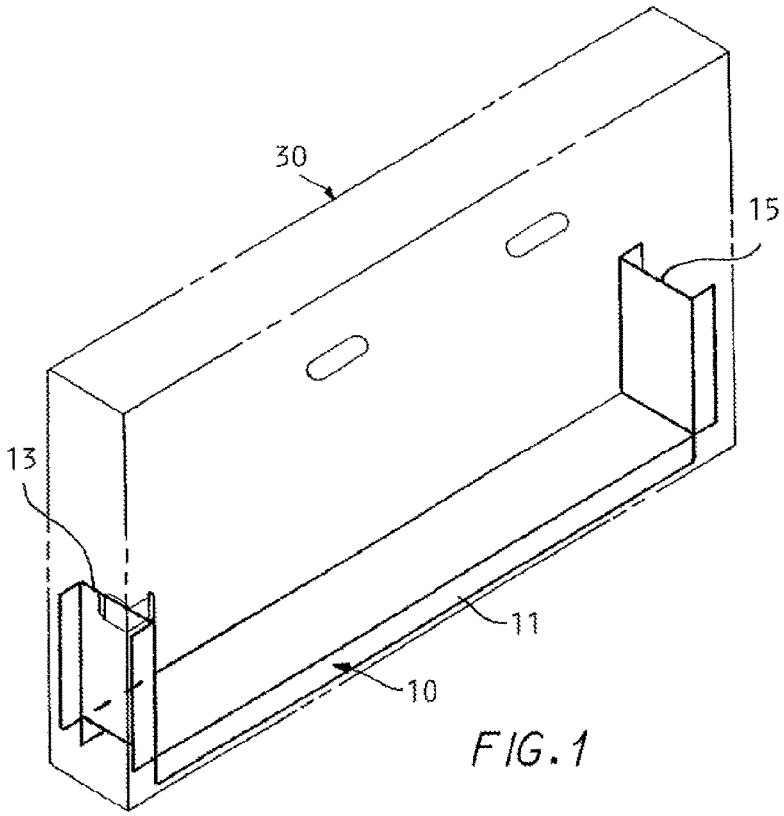
FIG. 1 is a schematic perspective view of the suspension pad of the present invention disposed within a corrugated enclosure.

Referring to the drawings, the present invention will now be described in detail with reference to the disclosed embodiment.

FIG. 1 shows a suspension pad 10 of the present invention. The suspension pad 10 is receivable within a corrugated enclosure 30 formed from corrugated board, such as cardboard or the like. A workpiece (not shown) is receivable within the corrugated enclosure 30 and upon the suspension pad 10. The corrugated enclosure 30 may include a pair of closure flaps 42, 44, moveable between a first, open position, wherein an opening 41 is defined in the end of the corrugated enclosure 30 between the closure flaps 42, 44, and a second, closed position, wherein the opening 41 in the corrugated enclosure 30 is obstructed by the closure flaps 42, 44. The suspension pad 10 includes a first end portion 13 moveable between a first, raised position, wherein the first end portion 13 is disposed within the corrugated enclosure 30, and a second, lowered position, wherein the first end portion 13 extends through the opening 41 such that the first end portion 13 engages the closure flaps 42, 44 to thereby keep the closure flaps 42, 44 in a spaced relationship with one another.

Figure 3:
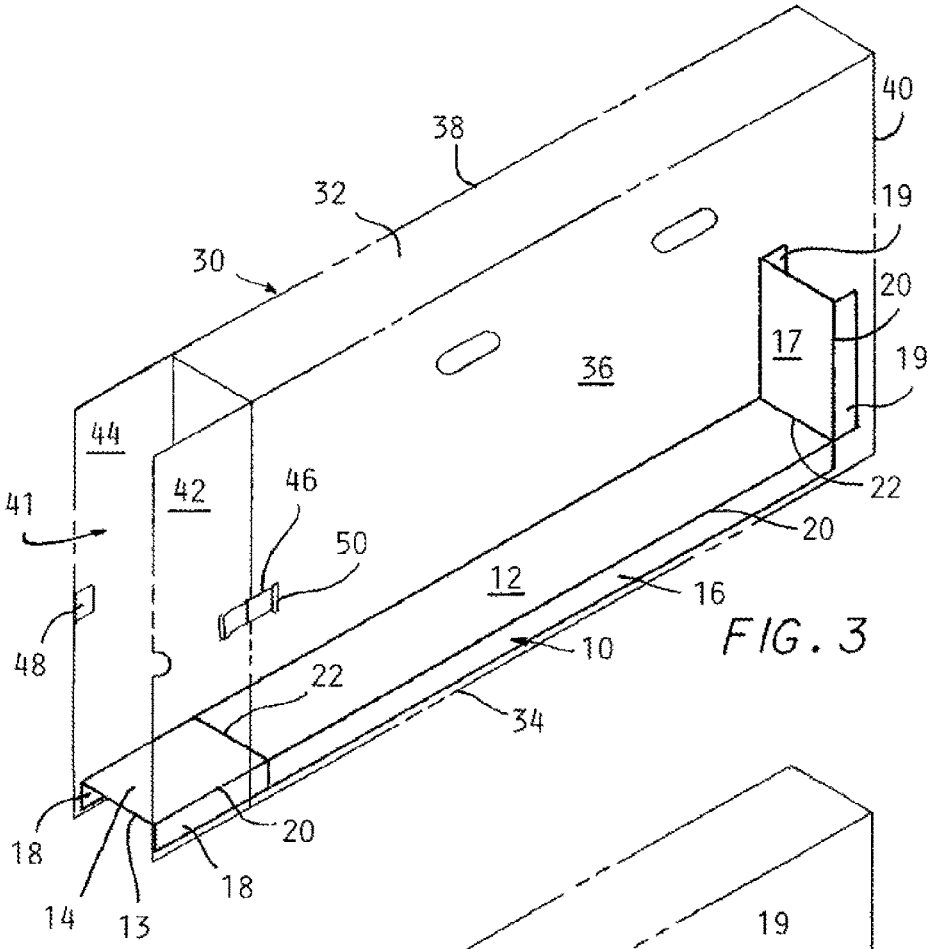
FIG. 3 is a schematic perspective view of the suspension pad of the present invention disposed within a corrugated enclosure.

The corrugated enclosure 30 allows the workpiece to be protected during transportation and storage of the workpiece. Accordingly, the corrugated enclosure 30 may be any structure in which the suspension pad 10 may be received to support the workpiece, including, but not limited to, the particular structure described herein. As shown in FIG. 3, the corrugated enclosure 30 includes a substantially planar bottom surface 34 and a substantially planar top surface 32, which lies spaced apart from and substantially parallel to the bottom surface 34. A first substantially planar side surface 36 extends between an edge of the bottom surface 34 and an edge of the top surface 32. The first substantially planar side surface 36 extends substantially perpendicularly to both the top surface 32 and the bottom surface 34. A second substantially planar side surface 38 extends between edges of the top surface 32 and the bottom surface 34 opposite the first substantially planar side surface 36. The second substantially planar side surface 38 is substantially perpendicular to the top and bottom surfaces 32, 34 and substantially parallel to the first substantially planar side surface 36. A substantially planar end surface 40 extends substantially perpendicularly with respect to the top surface 32, the bottom surface 34, the first side surface 36, and the second side surface 38. The end surface 40 has four edges, and each of the edges is connected to one of the top surface 32, bottom surface 34, first side surface 36, or second side surface 38.

Selective opening and closing of the corrugated enclosure 30 is provided by the pair of closure flaps 42, 44, particularly, the substantially planar inner closure flap 42 and the substantially planar outer closure flap 44. The substantially planar inner closure flap 42 is hingedly connected to the first side surface 36, and the substantially planar outer closure flap 44 is hingedly connected to the second side surface 38. The hinged connections between the inner and outer closure flaps 42, 44 and the first and second side surfaces 36, 38 may be formed by creases, folds, or perforations 22 in the corrugated material from which the corrugated enclosure 30 is constructed. Accordingly, the inner and outer closure flaps 42, 44 may pivot with respect to the first and second side surfaces 36, 38 between the open position and the closed position.

When the closure flaps 42, 44 are in the closed position, the inner closure flap 42 is adjacent to the interior of the corrugated enclosure 30, and the outer closure flap 44 is adjacent to the exterior of the corrugated enclosure 30. When the closure flaps 42, 44 are in the open position, the inner closure flap 42 is substantially parallel to the outer closure flap 44, and the opening 41 in the end of the corrugated enclosure 30 is defined by the space between the inner and outer closure flaps 42, 44. When the closure flaps 42, 44 are in the open position, the opening 41 is unobstructed, and the workpiece may pass through the opening 41 and into the corrugated enclosure 30 for packaging. When the closure flaps 42, 44 are in the closed position, the opening 41 is obstructed by the closure flaps 42, 44, and the workpiece may not pass through the opening 41.

Figure 4:
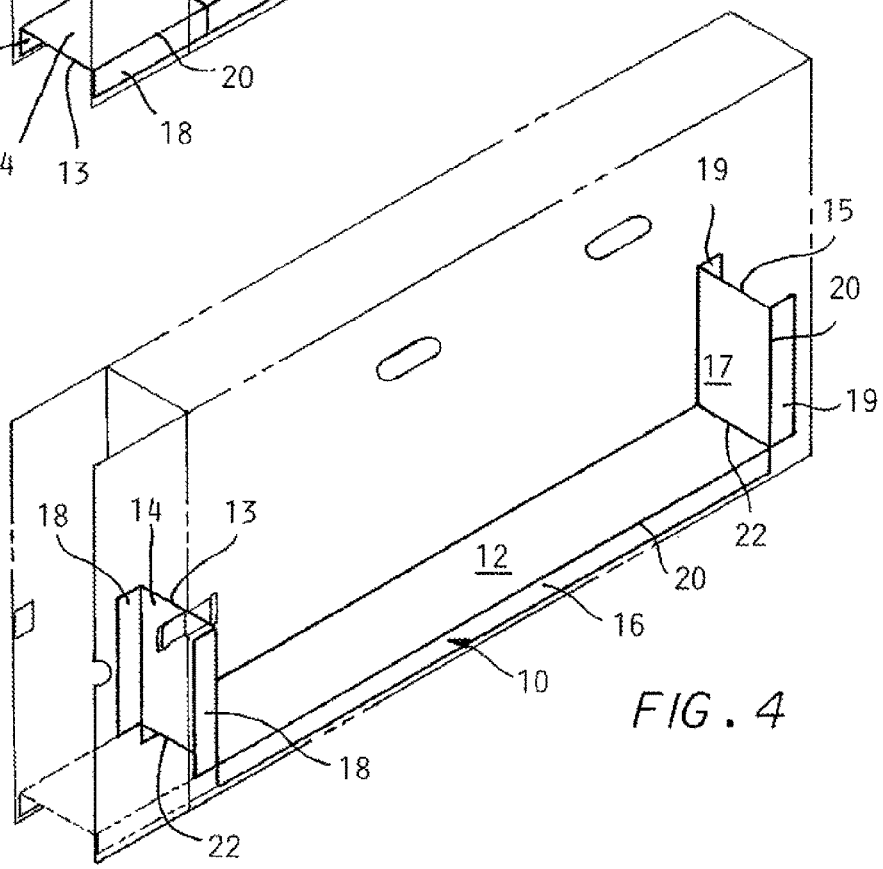
FIG. 4 is a schematic perspective view of the suspension pad of the present invention disposed within a corrugated enclosure.

In order to hold the inner closure flap 42 and the outer closure flap 44 of the corrugated enclosure 30 in the closed position, a closure strip 46 and a closure pad 48 are connected to the corrugated enclosure 30. The closure strip 46 is attached to the interior of the corrugated enclosure 30 and extends through a slot 50 formed in the first side surface 36 of the corrugated enclosure 30. The closure pad 48 is provided on an outer surface of the outer closure flap 44. The closure strip 46 and the closure pad 48 are complementary fastener elements that may be held in secure engagement with respect to one another. For example, the closure strip 46 and the closure pad 48 may be complementary hook and loop type fasteners, as seen in FIGS. 1, 3, and 4. When the inner closure flap 42 and the outer closure flap 44 are in the closed position, as seen in FIG. 1, engagement of the closure strip 46 and the closure pad 48 prevents the inner closure flap 42 and the outer closure flap 44 from moving toward the open position thereby holding the first end portion 13 of the suspension pad 10 into the raised position.

Figure 2:
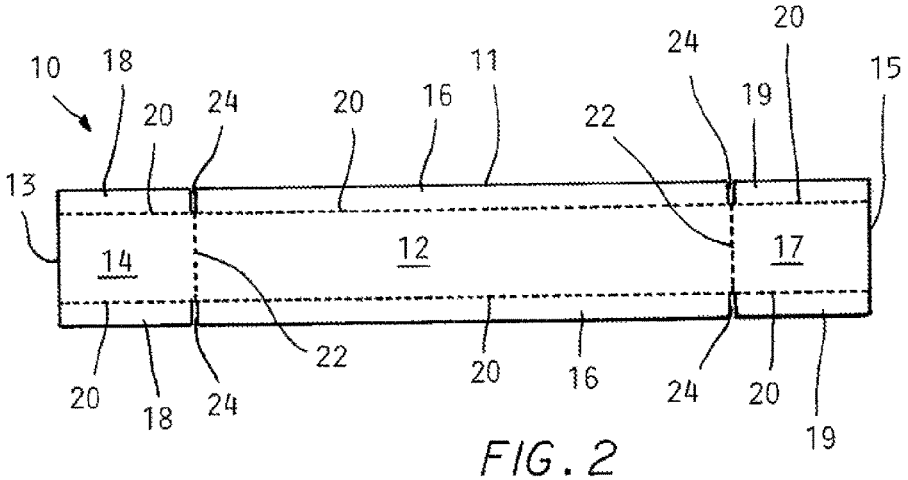
FIG. 2 is a top plan view of the suspension pad of the present invention.

The suspension pad 10 is receivable in the corrugated enclosure 30 to hold the workpiece in a spaced relationship with regard to the bottom surface 34, the end surface 40, and the inner closure flap 42 of the corrugated enclosure 30. As shown in FIG. 2, the suspension pad 10 may be formed from a corrugated material, such as cardboard, and includes a mid-section 11 and the first end portion 13. The suspension pad 10 may also include a second end portion 15. The first and second end portions 13, 15 may be formed integrally with the mid-section 11 and are hingedly connected to opposite ends of the mid-section 11 by the pair of transverse folds 22 that extend along transverse sides of the mid-section 11. Similarly, a pair of longitudinal folds 20 extends longitudinally across the suspension pad 10. The transverse folds 22 and the longitudinal folds 20 may be formed by folding, creasing, or perforating the suspension pad 10, such that the suspension pad 10 is bendable at the transverse folds 22 and the longitudinal folds 20.

The mid-section 11 is substantially planar and includes a middle portion 12 and a pair of sides 16 that may pivot with respect to the middle portion 12 of the mid-section 11 about the longitudinal folds 20. The transverse folds 22 extend along transverse sides of the middle portion 12 of the mid-section 11, substantially perpendicular to the longitudinal folds 20. The transverse perforations 22 are located on opposite ends of the middle portion 12 of the mid-section 11 and are adjacent to each of the first and second end portions 13, 15.

Each of the first and second end portions 13, 15 may pivot with respect to the mid-section 11 about the transverse perforations 22. The first end portion 13 includes a middle portion 14 and a pair of sides 18 extending from the longitudinal folds 20 along the longitudinal sides of the middle portion 14 of the first end portion 13. Likewise, the second end portion 15 includes a middle portion 17 and a pair of sides 19 extending from the longitudinal folds 20 along the longitudinal sides of the middle portion 17 of the second end portion 15. So that the first and second end portions 13, 15 may pivot with respect to the mid-section 11, slots 24 are formed adjacent to the transverse perforations 22 in between the pair of sides 16 of the mid-section 11, the pair of sides 18 of the first end portion 13, and the pair of sides 19 of the second end portion 15.

The suspension pad 10 may hold the workpiece in a spaced relationship with the corrugated enclosure 30, and thus, the pair of sides 16 of the mid-section 11 may pivot with respect to the middle portion 12 of the mid-section 11, the pair of sides 18 of the first end portion 13 may pivot with respect to the middle portion 14 of the first end portion 13, and the pair of sides 19 of the second end portion 15 may pivot with respect to the middle portion 17 of the second end portion 15. Thus, the pair of sides 16 of the mid-section 11 may pivot such that they extend substantially perpendicularly downward from the mid-section 11. When the suspension pad 10 is disposed within the corrugated enclosure 30, the pair of sides 16 of the mid-section 11 engages the bottom surface 34 of the corrugated enclosure 30 to keep the mid-section 11 spaced apart from the bottom surface 34. Likewise, the pair of sides 18, 19 of the first and second end portions 13, 15 may be pivoted such that they extend substantially perpendicular to the first and second end portions 13, 15. While the suspension pad 10 is disposed within the corrugated enclosure 30, the second end portion 15 extends substantially perpendicular to the mid-section 11. Thus, the pair of sides 19 of the second end portion 15 engage the end surface 40 of the corrugated enclosure 30 to keep the second end portion 15 spaced apart from the end surface 40, such that the middle section 17 of the second end portion 15 extends substantially parallel to the end surface 40 of the corrugated enclosure 30. Likewise, when the inner and outer closure flaps 42, 44 of the corrugated enclosure 30 are in the closed position, the first end portion 13 is in the raised position such that the pair of sides 18 of the first end portion 13 engage the inner closure flap 42 to keep the first end portion 13 spaced apart from the inner closure flap 42 of the corrugated enclosure 30.

The ability of the first end portion 13 of the suspension pad 10 to move between the raised position and the lowered position allows the inner closure flap 42 and the outer closure flap 44 of the corrugated enclosure 30 to be held in the open position while the workpiece is being loaded into the corrugated enclosure 30. When the first end portion 13 is in the lowered position, the pair of sides of the first end portion 13 engages the inner and outer closure flaps 42, 44 to hold the inner closure flap 42 spaced apart from the outer closure flap 44. Thus, while the first end portion 13 is in the lowered position, the inner closure flap 42 is substantially parallel to the first side surface 36, and the outer closure flap 44 is substantially parallel to the second side surface 38. Accordingly, when the first end portion 13 is in the lowered position, the workpiece may be passed through the opening 41 of the corrugated enclosure 30 without the workpiece being obstructed by the inner or outer closure flaps 42, 44. Additionally, since the middle portion 14 of the first end portion 13 is substantially parallel to the middle portion 12 of the mid-section 11 when the first end portion 13 is in the lowered position, the workpiece may be passed through the opening 41 of the corrugated enclosure 30 when the first end portion 13 is in the lowered position without the workpiece being obstructed by the first end portion 13.

It is noted that the second end portion 15 may be formed such that it is substantially similar to the first end portion 13. Accordingly, the end surface 40 of the corrugated enclosure 30 may be configured as a moveable closure flap that may open to define a second opening at the opposite end of the corrugated enclosure 30 from the opening 41. Thus, the corrugated enclosure 30 may provide two points of access for loading and unloading.

In use, the inner closure flap 42 and the outer closure flap 44 of the corrugated enclosure 30 are placed in the open position such that the opening 41 is defined between the inner and outer closure flaps 42, 44 in an unobstructed manner. The suspension pad 10 is then inserted into the corrugated enclosure 30 such that the pair of sides 19 of the second end portion 15 engages the end surface 40 of the corrugated enclosure 30. The first end portion 13 is moved to the lowered position such that the first end portion 13 extends through the opening 41 between the inner closure flap 42 and the outer closure flap 44, thereby holding the inner and outer closure flaps 42, 44 in the open position.

With the inner closure flap 42 and the outer closure flap 44 held in the open position, the corrugated enclosure 30 is ready to receive the workpiece. The workpiece is inserted into the corrugated enclosure 30 through the opening 41 and placed upon the mid-section 11 of the suspension pad 10. Once the workpiece has been placed upon the suspension pad 10, the first end portion 13 is moved from the lowered position to the raised position. In order to hold the first end portion 13 in the raised position, the inner closure flap 42 is moved to the closed position such that the inner closure flap 42 abuts the pair of sides 18 of the first end portion 13. The outer closure flap 44 is then moved to the closed position, and the closure strip 46 is secured with respect to the closure pad 48 to thereby hold the inner closure flap 42 and the outer closure flap 44 in the closed position thereby securing the first end portion 13 in the raised position. After the corrugated enclosure 30 has been closed, the workpiece is held in spaced relationship with respect to the bottom surface 34, the end surface 40 and the inner closure flap 42 of the corrugated enclosure 30 by engagement of the first and second end portions 13, 15 and the mid-section 11 of the suspension pad 10 with the workpiece.

The workpiece is removed from the corrugated enclosure 30 by first disengaging the closure strip 46 from the closure pad 48. The inner and outer closure flaps 42, 44 are then moved from the closed position to the open position so that the opening 41 is defined between the inner and outer closure flaps 42, 44. The first end portion 13 is then moved from the raised position to the lowered position. The workpiece is then moved through the opening 41 and out of the corrugated enclosure 30, as the first end portion 13 holds the inner closure flap 42 and the outer closure flap 44 in the open position such that the workpiece is not obstructed from exiting the corrugated enclosure 30.

While the invention has been described in connection with what is presently considered to be the most practical and preferred embodiment, it is to be understood that the invention is not to be limited to the disclosed embodiments, but to the contrary, it is intended to cover various modifications of equivalent arrangements included within the spirit and scope of the appended claims and which scope is intended to be accorded the broadest interpretation so as to encompass all such modifications and equivalent structures as is permitted under the law.

What is claimed is:

1. A container assembly for a workpiece, comprising:

a corrugated enclosure having a first surface, said first surface connected to a second surface, said second surface connected to a third surface, said third surface connected to a fourth surface, and said fourth surface connected to said first surface;

a first closure flap pivotally connected to said second surface, and said first closure flap moveable between a closed position, wherein said first closure flap is substantially perpendicular to said second surface, and an open position, wherein said first closure flap is substantially parallel to said second surface;

a second closure flap pivotally connected to said fourth surface and moveable between a closed position, wherein said second closure flap is substantially perpendicular to said fourth surface and overlies at least a portion of said first closure flap, and an open position, wherein said second closure flap is substantially parallel to said fourth surface and said first closure flap;

a suspension pad having a midsection and at least one end portion, said midsection abutting said third surface within said corrugated enclosure and said midsection having a substantially planar middle portion that is engageable with said workpiece, and said at least one end portion having a substantially planar middle portion, wherein said middle portion of said at least one end portion is pivotally connected to said middle portion of said midsection; and said at least one end portion pivotally moveable between a raised position, wherein said at least one end portion is disposed within said corrugated enclosure to allow said first and second closure flaps to move to said closed position, and a lowered position, wherein said at least one end portion extends out from said corrugated enclosure to engage and hold said first and second closure flaps in said open position to define an unobstructed opening between the middle portion of the at least one end portion and the fourth first surface of the corrugated enclosure for allowing the workpiece to pass therethrough.

2. The container assembly stated in claim 1, further comprising:

said first surface of said corrugated enclosure substantially planar and substantially perpendicular to said second surface of said corrugated enclosure;

said second surface of said corrugated enclosure substantially planar and substantially perpendicular to said third surface of said corrugated enclosure;

said third surface of said corrugated enclosure substantially planar and substantially perpendicular to said fourth surface of said corrugated enclosure; and said fourth surface of said corrugated enclosure substantially planar and substantially perpendicular to said first surface of said corrugated enclosure, wherein said first, second, third, and fourth surfaces of said corrugated enclosure form a substantially rectangular enclosure.

3. The container assembly stated in claim 1, further comprising:

said midsection of said suspension pad having a substantially U-shaped configuration defined by said substantially planar middle portion of said midsection and a pair of substantially planar sides that extend downward substantially perpendicular from said middle portion of said midsection of said suspension pad for engaging said third surface of said corrugated enclosure.

4. The container assembly stated in claim 3, further comprising:

said at least one end portion having a substantially U-shaped configuration defined by said substantially planar middle portion of said at least one end portion and a pair of substantially planar sides that extend substantially perpendicular to said middle portion of said at least one end portion at longitudinal folds, wherein said pair of planar sides engage at least one of said first and second closure flaps in said closed position.

5. The container assembly stated in claim 4, further comprising:

said middle portion of said at least one end portion connected to said middle portion of the midsection of the suspension pad by a transverse fold.

6. The container assembly stated in claim 5, further comprising:

said pair of sides of said at least one end portion spaced from said pair of sides of said midsection of said suspension pad by transverse slots that are adjacent to and aligned with said transverse fold.

7. The container assembly stated in claim 6, further comprising:

said middle portion and said sides on said at least one end portion being substantially rectangular; and said middle portion and said sides of said midsection of said suspension pad being substantially rectangular.

8. The container assembly stated in claim 1, further comprising:

a closure strip connectable to said second surface of said corrugated enclosure, and a closure pad connectable to said first closure flap, and said closure strip cooperatable with said closure pad to define an engaged position, wherein said closure strip is engageable with said closure pad to restrain said closure flap from moving from said closed position to said open position and to restrain said at least one end portion from moving from said raised position to said lowered position, and a disengaged position, wherein said closure flap may move from said closed position to said open position and said at least one end portion may move from said raised position to said lowered position.

9. A container assembly for a workpiece, comprising:

a corrugated enclosure having a first substantially planar surface, said first surface connected to a second substantially planar surface, said second surface connected to a substantially planar third surface, said third surface connected to a substantially planar fourth surface, and said fourth surface connected to said first surface, wherein said first, second, third, and fourth surfaces form a substantially rectangular enclosure;

a first closure flap pivotally connected to said second surface, and said first closure flap moveable between a closed position, wherein said first closure flap is substantially perpendicular to said second surface, thereby closing an end of said corrugated enclosure and an open position, wherein said first closure flap is substantially parallel to said second surface, thereby opening said end of said corrugated enclosure;

a second closure flap pivotally connected to said fourth surface and moveable between a closed position, wherein said second closure flap is substantially perpendicular to said first surface and overlies at least a portion of said first closure flap to assist in closing said end of said corrugated enclosure, and an open position, wherein said second closure flap is substantially parallel to said fourth surface and said first closure flap to open said end of said corrugated enclosure;

a suspension pad having a midsection abutting said third surface within said corrugated enclosure and having at least one end portion pivotally connected to said midsection of said suspension pad, said midsection of said suspension pad having a substantially U-shaped configuration defined by a substantially planar middle portion that is engageable with said workpiece and a pair of substantially planar sides that extend downward substantially perpendicular from said middle portion of said midsection of said suspension pad for engaging said third surface of said corrugated enclosure, and said at least one end portion having a substantially U-shaped configuration defined by a substantially planar middle portion and a pair of substantially planar sides that extend substantially perpendicular to said middle portion of said at least one end portion at longitudinal folds; and said at least one end portion moveable between a raised position, wherein said at least one end portion is disposed within said corrugated enclosure to allow said first and second closure flaps to move to said closed position, and a lowered position, wherein said at least one end portion extends out from said corrugated enclosure to engage and hold said first and second closure flaps in said open position to define an unobstructed opening between the middle portion of the at least one end portion and the fourth first surface of the corrugated enclosure for allowing the workpiece to pass therethrough.

10. The container assembly stated in claim 9, further comprising:

said middle portion of said at least one end portion connected to said middle portion of the midsection of the suspension pad by a transverse fold.

11. The container assembly stated in claim 10, further comprising:

said pair of sides of said at least one end portion spaced from said pair of sides of said midsection of said suspension pad by transverse slots that are adjacent to and aligned with said transverse fold.

12. A container assembly for a workpiece, the container assembly comprising:

a corrugated enclosure including:

a substantially planar bottom surface, a substantially planar top surface, a first side surface that extends between and interconnects the bottom surface and the top surface, a second side surface that extends between and interconnects the bottom surface and the top surface, a first closure flap that is pivotally connected to the first side surface, the first closure flap moveable between a closed position, wherein the first closure flap extends substantially perpendicular to the first side surface, and an open position, and a second closure flap that is pivotally connected to the second side surface, the second closure flap moveable between a closed position, wherein the second closure flap extends substantially perpendicular to the second side surface, and an open position, and an opening with respect to an interior of the enclosure, wherein the opening is defined when the first closure flap and the second closure flap are in their open positions; and a suspension pad defined by a folded, unitary corrugated cardboard panel, the suspension pad including:

a mid-section having a substantially planar, substantially rectangular middle portion that is engageable with said workpiece and a pair of sides that extend downward from the middle portion of the mid-section, and at least one end portion having a substantially planar, substantially rectangular middle portion, and a pair of sides that extend downward from the middle portion of the at least one end portion at longitudinal folds, the middle portion of the at least one end portion being connected to the middle portion of the mid-section at a transverse fold, such that the at least one end portion is moveable with respect to the mid-section between a raised position and a lowered position by pivotal motion of the at least one end portion with respect to the mid-section at the transverse fold, wherein the suspension pad is disposed within the corrugated enclosure such that the sides of the mid-section engage the bottom surface of the corrugated enclosure to space the middle portion of the mid-section from the bottom surface of the corrugated enclosure, the sides of the mid-section engage the first and second side surfaces, respectively, of the corrugated enclosure to restrain transverse movement of the suspension pad with respect to the corrugated enclosure, and the at least one end portion of the suspension pad is disposed adjacent to the first and second closure flaps, such that the sides of the at least one end portion are adjacent to at least one of the first closure flap or the second closure flap when the at least one end portion is in the raised position, the sides of the at least one end portion are spaced from the bottom surface of the corrugated enclosure when the at least one end portion is in the raised position, and the at least one end portion extends out of the opening defined in the corrugated enclosure when the first and second closure flaps are in the open position and the at least one end portion of the suspension pad is in the lowered position, wherein the sides of the at least one end portion of the suspension pad engage the first closure flap and the second closure flap, respectively, of the corrugated enclosure to restrain the first and second closure flaps of the corrugated enclosure from moving from their open positions to their closed positions while the at least one end portion of the suspension pad is disposed in the lowered position with the transverse fold located within the corrugated enclosure such that the opening of the enclosure is unobstructed between the middle portion of the at least one end portion and the top surface of the enclosure when the at least one end portion of the suspension pad is in the lowered position.

* * * * *